United States Patent [19]

Daley

[11] Patent Number: 4,928,441

[45] Date of Patent: May 29, 1990

[54] ATTIC ACCESS STAIRWAY COVER

[75] Inventor: John G. Daley, 2143 Echo La., Wilmington, N.C. 28403

[73] Assignee: John G. Daley, Wilmington, N.C.

[21] Appl. No.: 387,751

[22] Filed: Jul. 31, 1989

[51] Int. Cl.[5] ..... E04B 7/18

[52] U.S. Cl. ..... 52/19; 52/202; 182/77

[58] Field of Search ..... 52/202, 124.1, 129.2, 52/19; 182/77, 81

[56] References Cited

U.S. PATENT DOCUMENTS 4,541,208 9/1985 Vesperman et al. ..... 182/77 X
4,550,534 11/1985 Mariano et al. ..... 52/19
4,658,555 4/1987 Steiner ..... 52/202

*Primary Examiner*—David A. Scherbel
*Assistant Examiner*—Creighton Smith

[57] ABSTRACT

A box-shaped enclosure, open on its bottom, pivotally mounted over an attic access stairway, so a foldable, downward stairway mounted in the opening, may be upwardly raised and stored therewithin.

2 Claims, 1 Drawing Sheet

FIG. 1
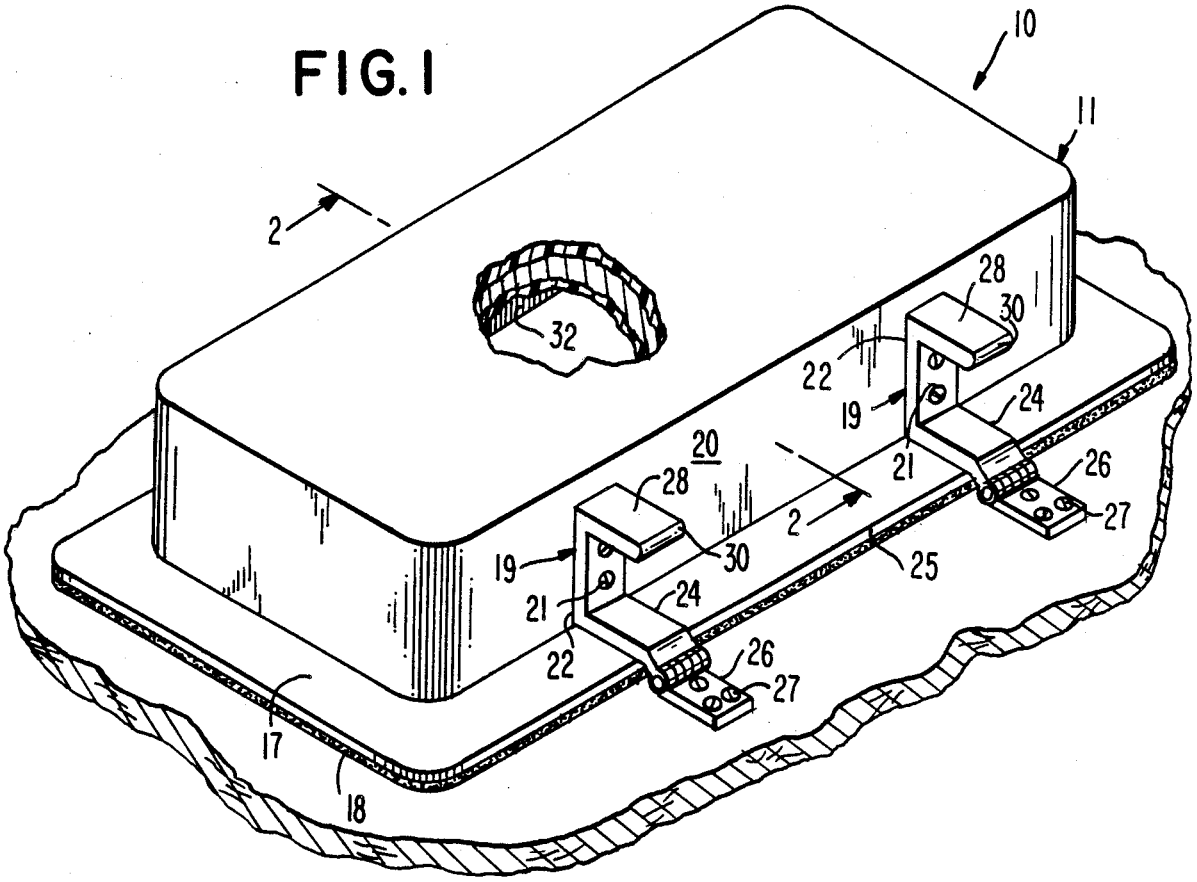
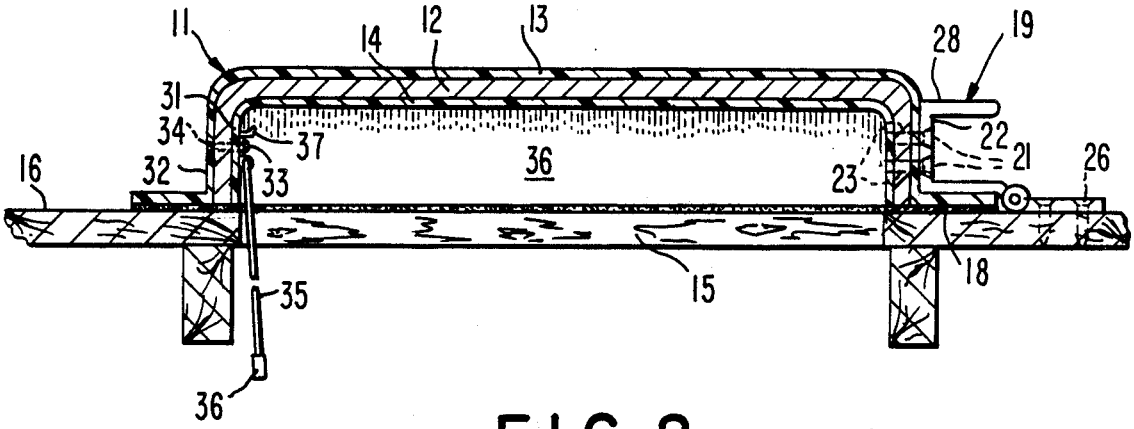
FIG. 2

ATTIC ACCESS STAIRWAY COVER

BACKGROUND AND FIELD OF THE INVENTION

This invention relates generally to attic folding stairway accessories, and more specifically, it relates to attic stairwell closures.

PRIOR ART

It is well known that numerous designs of attic folding stairways have been installed within private homes in past years. The stairway made to be stored within an opening through the attic floor when not in use and to be downwardly unfolded therefrom when access is wished to the attic from a residential floor therebelow. A problem with all of these designs is to make them to be air-tight when in closed position so to prevent loss of heated or air-conditioned air from below to escape into the attic. Also to prevent attic dust to enter the residential floor therebelow. An air-tight seal is not easily accomplished between a suspended member and its support member located thereabove, and even if it can be done, there still remains the problem of attic dust that is settled upon a top of the folded away stairway assembly, which spills down into the residential quarters when the stairway is lowered for use. This situation is objectionable and is therefore in need of an improvement.

SUMMARY OF THE INVENTION

Accordingly it is a principal object of the present invention to provide a cover over a top of the attic stairwell which fits snuggly against the attic floor so to prevent air draft therethrough carrying any thermal changes and which shields the folded away stairway from any draft to settle thereupon.

Another object is to provide an attic access stairway cover which may be quickly and easily moved between an opened or closed position so to allow attic access to anyone without need of special strength such as by women or older persons.

Yet another object is to provide an attic access stairway cover which is hinge mounted and includes stop means so to limit pivotal travel only within relatively effortless range.

Other objects are to provide an attic access stairway cover which is simple in design, inexpensive to manufacture, rugged in construction and efficient in operation.

These and other objects will be readily evident upon a study of the following specification and the accompanying drawing.

BRIEF DESCRIPTION OF THE DRAWING FIGURES

FIG. 1 is a top perspective view of an attic access stairway cover shown in accordance with the present invention, and FIG. 2 is a cross-sectional view taken along line 2—2 of FIG. 1.

DETAILED DESCRIPTION OF PREFERRED EMBODIMENT

Referring now to the drawing in greater detail, the reference numeral 10 represents an attic access stairway cover that includes a main body 11 shaped like an inverted shallow tub, and which consists of a strong central core 12 sandwiched between an outer layer 13 and inner layers 14 of molded fiberglass or other nonflammable plastic material capable to be rigid. The core 12 may be made either of metal, wood or a wood product such as masonite molded from wood chips, so as to give some substatial weight to the main body 11. It is rectangular in configuration, measuring approximately thirty inches wide, sixty inches long and eight inches deep on its inner side so as to extend across a conventional sized attic stairway opening 15 made through an attic floor 16. A edge of the core 12 is extended outwardly at a right angle so to form a horizontal flange 17 all around so to rest upon the attic floor. A pad 18 of flexible sponge rubber is adhered to an underside of the flange 17 and serves to make an air-tight fit against the surface of the attic floor while the weight of the main body 11 bears down against it.

A pair of hinges 19 fastened to one of the longer side walls 20 of the main body 11 by means of screws 21 through hinge plates 22 and being secured in topped openings 23 extending through the core 12. The hinge plate 22 is channel shaped so that one leg 24 thereof extends to an edge 25 of the flange 17 where it is pivotally connected to a hinge plate 26 used for fastening by screws 27 to the attic floor 16. The other leg 28 of the hinge plate 22 extends straight out at a right angle from the wall 20 and is almost the same length as the leg 24 so that when the cover is pivoted upwardly the end edge 30 of the legs 28 abutt the attic floor 16 and stop its pivotal travel beyond a reasonable distance where the cover will stand vertically upright by itself while the attic stairway is in use.

A bracket 31 is attached to an inner side of the opposite longer wall 32 of the main body 11 by means of a screw 33 in a topped opening 34 through the core 12. An elongated, rigid rod 35 pivotally attached at one end to the fittings has a handle 36 at its opposite end so that a person ascending the stairway can push the cover upwardly into an opened position, or when descending, to pull the cover downward into a closed position. The rod 35 may be stored away when not in use by pivoting it up into the underside cavity 36 of the cover and secured by insertion into a clasp 37 so to be out of the way of the stairway when folded upwardly and stored inside the cavity 36. The cavity 36 is of sufficient depth to contain a standard folding staircase or ladder therewithin.

In a modified design of the invention (not shown in the drawing), a plurality of transverse openings inside the core 12 extending between the opposite long walls 20 and 32. They are partly filled with a heavy liquid, so that the cover 10 in a horizontal position exerts a greater weight against all of the pad 18 so to compress its hardness against the attic floor 16 for a more thorough air seal therebetween.

While various changes made in the detailed construction, it is understood that such changes will be within the spirit and scope of the present invention as is defined by the appended claims.

What I claim as new is:

1. An attic access stairway cover, comprising in combination, an inverted tub-shaped main body for removable placement over an attic access opening through an attic floor, hinge means attached to said main body for upwardly pivoting of said main body away from said opening, and a cavity on an underside of said main body for an attic folding stairway to be upwardly stored therewithin from below; said main body comprising a strong central core sandwiched between layers of plastic; said main body being rectangular in shape and having a padded outwardly flange around its edge for resting upon said attic floor; and said hinge means comprising a pair of hinges attached to a longer side of said main body and each said hinge including stop means for abutment against said attic floor and limit a pivotal travel thereof.

2. The combination as set forth in claim 1 wherein a rigid rod pivotally attached to an inner side of an opposite longer side of said main body includes a handle at its opposite end for pushing or pulling said cover upwardly or downwardly.

* * * * *